US006742292B1

(12) United States Patent
Albano

(10) Patent No.: US 6,742,292 B1
(45) Date of Patent: Jun. 1, 2004

(54) MODULAR SIGN

(76) Inventor: Ferdinand Albano, 44 Ferry St., Everett, MA (US) 02149

( * ) Notice: Subject to any disclaimer, the term of this patent is extended or adjusted under 35 U.S.C. 154(b) by 0 days.

(21) Appl. No.: 10/214,223

(22) Filed: Aug. 7, 2002

Related U.S. Application Data

(60) Provisional application No. 60/311,228, filed on Aug. 9, 2001.

(51) Int. Cl.[7] ..... G09F 13/04
(52) U.S. Cl. ..... 40/568; 40/575
(58) Field of Search ..... 40/564, 568, 574, 40/575, 576

(56) References Cited

U.S. PATENT DOCUMENTS 3,866,343 A * 2/1975 Frost et al. ..... 40/568
4,292,752 A * 10/1981 Clark ..... 40/576
4,653,209 A * 3/1987 Cobb ..... 40/568
4,679,341 A * 7/1987 Goldman ..... 40/575
4,851,971 A * 7/1989 MacLagan ..... 40/564
4,977,698 A * 12/1990 Seggerson ..... 40/564
6,042,243 A * 3/2000 Grill et al. ..... 40/575

OTHER PUBLICATIONS

Your Place Quality Menu Systems Catalog, a Division of Impact International Inc.

* cited by examiner

*Primary Examiner*—Gary Hoge
(74) *Attorney, Agent, or Firm*—Weingarten, Schurgin, Gagnebin & Lebovici LLP

(57) ABSTRACT

A modular sign having a signboard that positively and removably engages a signboard housing. The signboard housing includes a top wall, left and right sidewalls and a lower wall. The housing also includes upper and lower upward extending lips extending from front edges of the top wall and the lower wall of the housing respectively. First and second hanger strips are mounted to the back surface of the signboard. The hanger strips form notches in conjunction with the back surface of the signboard. When the signboard is slidably disposed into a mounting position with respect to the signboard, the upper and lower lips upward extending lips extend into the notches formed by the first and second hanger strips to positively mount the signboard with respect to the housing while permitting easy removal of the signboard therefrom.

11 Claims, 7 Drawing Sheets

MODULAR SIGN

CROSS REFERENCE TO RELATED APPLICATIONS

This application claims priority under 35 U.S.C. §119(e) of U.S. Provisional Patent Application 60/311,228 filed Aug. 9, 2001, titled DISPLAY BOARD.

STATEMENT REGARDING FEDERALLY SPONSORED RESEARCH OR DEVELOPMENT

Not Applicable

BACKGROUND OF THE INVENTION

The present invention pertains to signs that are typically employed for the display of menu items and associated pricing information.

Signs are widely used within the food industry for the display of menu items and associated price information. Many types of signs have been constructed. The configuration of many signs available in the market place are not sufficiently flexible to accommodate the varied needs within the industry.

In particular, there is often a need to be able to add or delete items from a menu display sign and/or change the cost of items that are on the menu. Additionally, significant costs are incurred in designing and manufacturing custom display signs for the needs of particular customers.

Accordingly, it would be desirable to have a display sign that may be readily adapted to accomodate the needs or a large variety of customers without the need to produce custom housings. It would further be desirable for such a display sign to allow for the modification of the menu items displayed in the event of changes in the number of menu items, costs or the like.

BRIEF SUMMARY OF THE INVENTION

In accordance with the present invention, a modular sign is disclosed. The sign includes a housing having a light fixture mounted therein. The housing has a top wall, left and right side walls and a lower wall and is open at the back and the front of the housing. A first upward extending lip is provided at the front edge of the top wall of the housing for use in mounting a signboard to the housing. A second lip extends upward from the lower wall of the housing and is also employed for positively mounting the signboard to the housing. Inward extending flanges are provided on the front edge of the left and right side walls to provide support for the signboard. The signboard comprises a laminated structure that includes a backing board, an intermediate spacing grid and a display grid.

The intermediate spacing grid includes a vertical member along one edge and a plurality of horizontal members extending therefrom. Pockets are formed between adjacent horizontal members of the spacing grid that are sized to receive removable signage strips that typically include alphanumeric menu information. The signage strips are formed of translucent material and have a semi-opaque coating on selected areas of the signage strips. No coating is typically applied over the signage strip in the areas comprising the menu letters and price. The lettering on the signage strips is visible through openings within the display grid when the signage strips are slidably disposed within the laminated signboard. Thus, when the signboard is mounted to the housing and the signboard is backlit via the lighting fixture, the menu items and pricing information are readily discernable.

A first hanger is mounted and extends horizontally along the back top side of the backing board and a second hanger is mounted and extends horizontally along the back bottom side of the backing board. The first hanger engages the first lip on the front of the top wall of the housing when the signboard is disposed in a mounting position with respect to the housing. Similarly the second hanger positively engages the second lip when the signboard is disposed in the mounting position. Mounting of the signboard to the housing in the disclosed manner provides for positive engagement of the signboard to the housing while allowing for easy removal of the signboard when changes to menu or display items are necessary.

When disposed in the mounting positing, the backing board rests against the flanges extending from the right and left side walls of the housing. Edge strips are mounted to the side walls of the housing to provide a finished appearance to the modular sign.

Additionally, a plurality of modular housings may be mounted side by side to accommodate the need for a greater number of menu items than may be displayed using a single housing. When a plurality of housings are mounted side-by-side, intermediate edge strips may be mounted to cover the joints at adjacent housings so as to provide a finished appearance for the assembled signboard Other features, aspects and advantages of the invention will be apparent from the Detailed Description of the Invention that follows.

BRIEF DESCRIPTION OF THE SEVERAL VIEWS OF THE DRAWING

The invention will be more fully understood by reference to the following Detailed Description of the Invention in conjunction with the drawing of which.

DETAILED DESCRIPTION OF THE INVENTION

Figure 1:
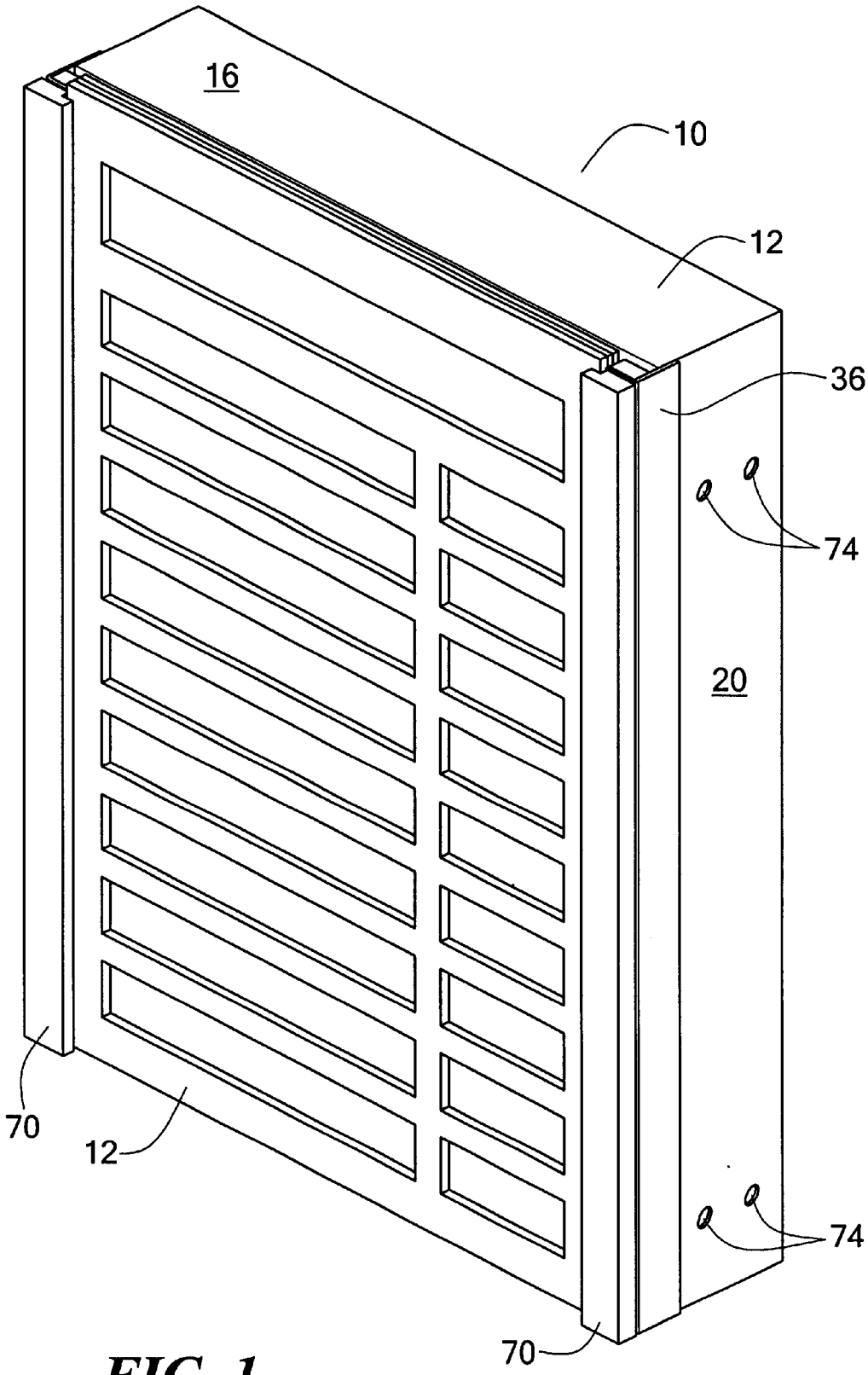
FIG. 1 is a perspective view of a modular sign in accordance with the present invention that includes a single housing.
Figure 2:
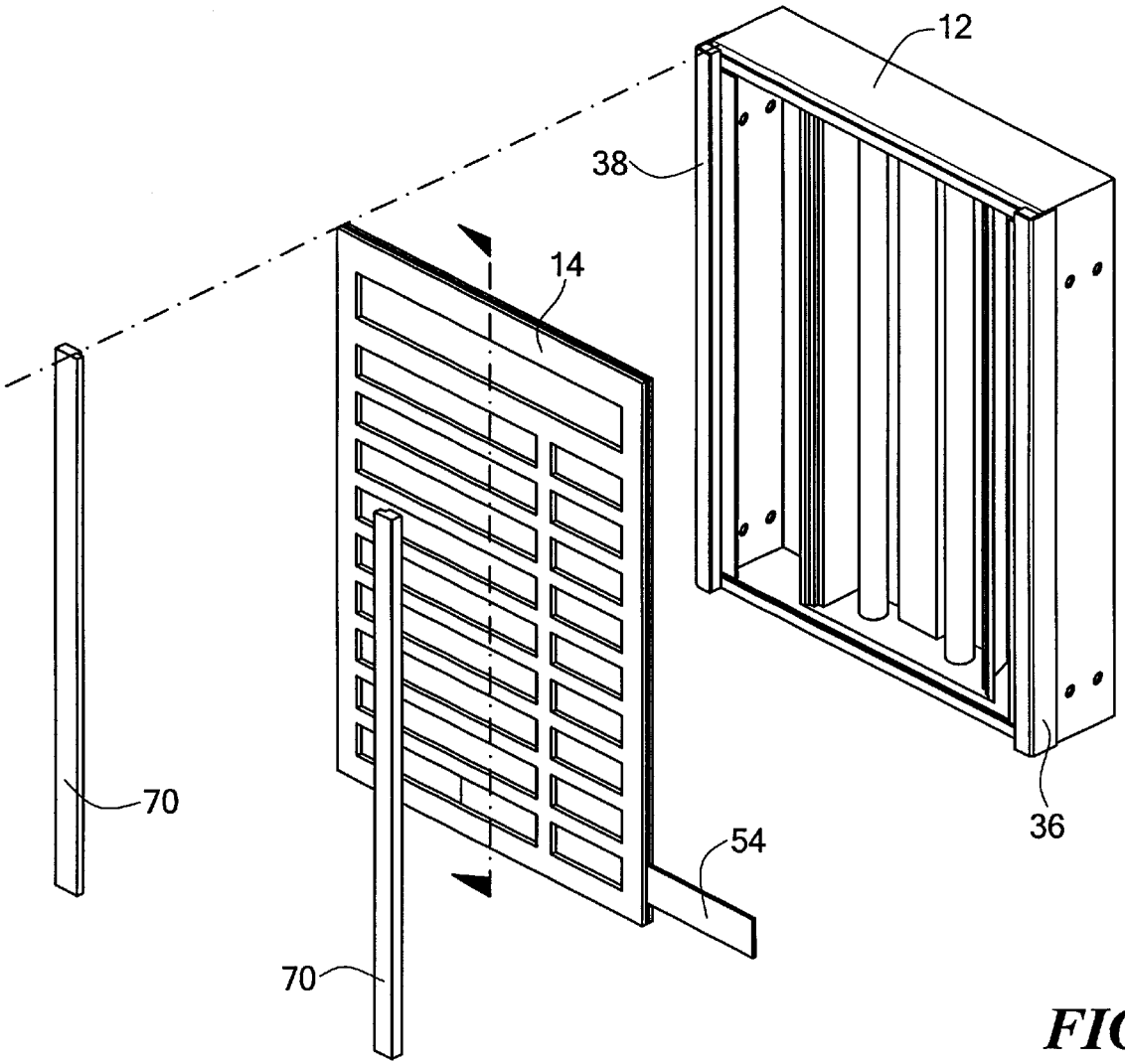
FIG. 2. is an exploded perspective view of the modular sign of FIG. 1.
Figure 3:
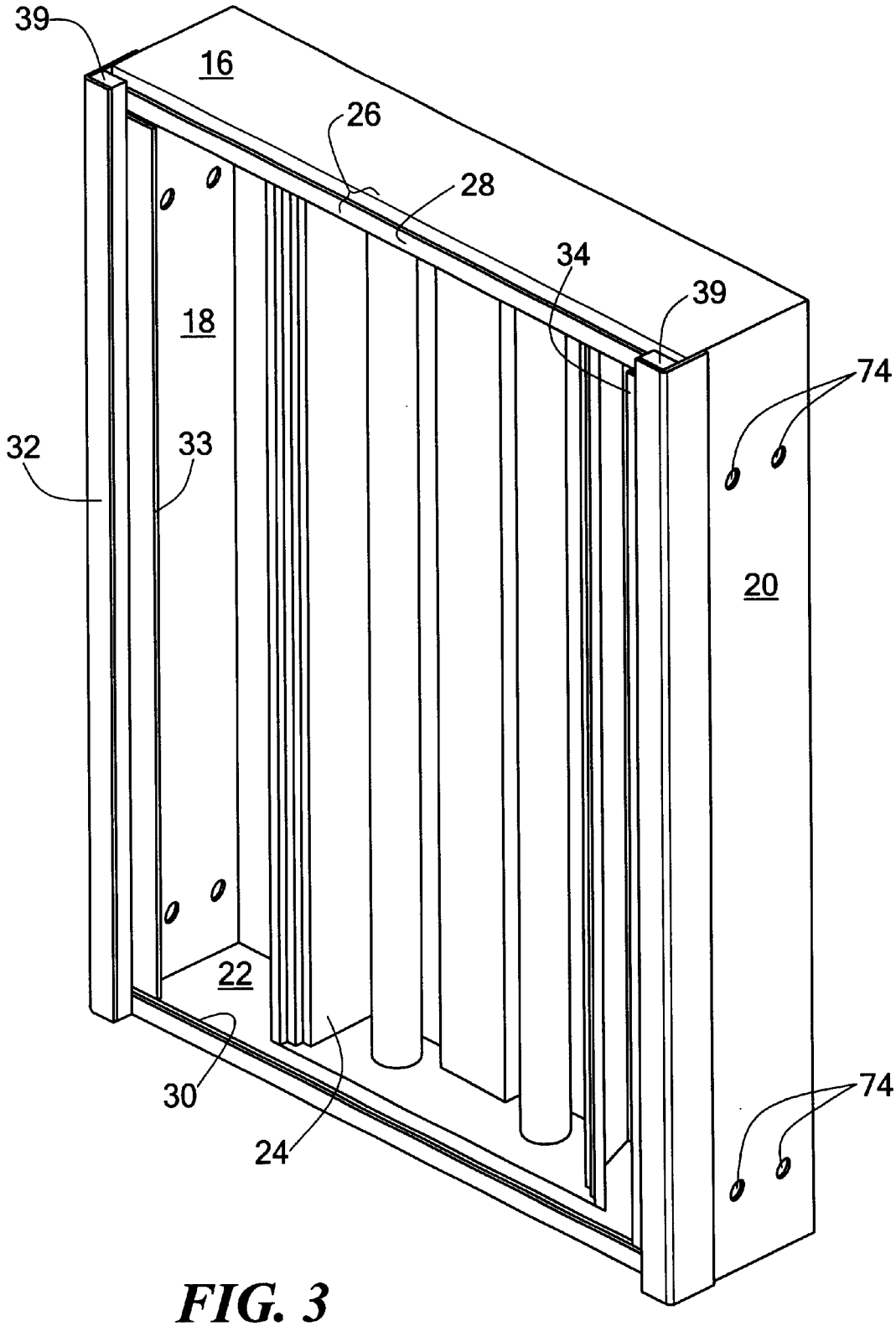
FIG. 3 is a perspective view of the housing of the modular sign depicted in FIG. 1.

U.S. Provisional Patent Application No. 60/311,228 filed Aug. 9, 2001, titled DISPLAY BOARD is incorporated herein by reference.

In accordance with the present invention a modular sign is disclosed. The modular sign includes a housing and a signboard. The signboard is mounted to the housing in a manner that provides positive engagement of the signboard with respect to the housing while allowing the signboard to be easily removed from the housing n order to make modifications to the signboard.

A modular sign 10 in accordance with the present invention s depicted in FIGS. 1–5. The modular sign 10 includes a housing 12 and a signboard 14. The housing 12 includes a top wall 16, left and right side walls 18 and 20 respectively, and a lower wall 22. A light fixture 24, such as a flourescent or incandescent light fixture, is mounted within the housing 12. In the illustrated embodiment, the light fixture 24 comprises a flourescent light fixture. When lights within the light fixture are powered, the light fixture provides backlighting for the signboard so that the information contained on the menu board is clearly visible. The housing 12 top wall 16 includes a generally U shaped lip 26 having a first vertical mounting edge 28 formed at the front edge of the top wall 16. Additionally, the housing 12 includes a second vertical mounting edge 30 extending upward from the front edge of the lower wall 22 and generally perpendicular to the the lower wall 22. Left and right support flanges 33 and 34 extend inward from the front edge of the left and right side walls 18 and 20 respectively and generally at right angles to the corresponding side walls 18 and 20. The housing 12 includes left and right corner members 36 that are mounted to the housing 12 along the front edges of the left and right side walls 18 and 20. The corner members 36 are mounted using any suitable fastener such as rivets, screws, nuts and bolts, or via use or an adhesive or a double-sided adhesive tape. The corner members 36 have a generally L shaped cross section with a generally planar frontal portion 38. In a preferred embodiment, the frontal portions 38 of the corner members 36 are spaced outward from the front edge of the left and right side walls 18 and 20 respectively via spacing strips 39 disposed between the frontal portion of the corner members 36 and the housing 12. The spacing strips 39 may be fabricated of plastic, metal, or any other suitable material. The signboard 14 is mounted to the front of the housing 12 between the left and right corner members 36. In a preferred embodiment, the housing 12 is fabricated as a formed and welded aluminum structure.

The signboard 14 is fabricated as a laminated assembly and includes a backing board 40, an intermediate spacing grid 42 and an outer display grid 44. In a preferred embodiment, the backing board 40, the intermediate spacing grid 42 and the outer display grid 44 are fabricated of a plastic material such as plexiglass. The backing board 40 comprises a solid sheet of translucent material. The intermediate spacing grid 42 comprises a vertical side member 48 and a plurality of fingers 50 extending horizontally from the vertical side member 48 so as to form pockets 52 sized to receive signage strips 54 when the outer display grid 44 is mounted to the intermediate spacing grid 42 and the intermediate spacing grid 42 is mounted to the backing board 40 to form the signboard 14. The intermediate spacing grid 42 is adhered or bonded to the backing board 40 and the outer display grid 44 is adhered or bonded to the intermediate spacing grid 42 using any suitable adhesive or bonding agent. Alternatively, the signboard 14 may be formed by fastening together the outer display grid 44, the intermediate spacing grid and the backing board 40 using fasteners such as screws, nuts and bolts, rivets, or any other suitable fasteners.

The outer display grid 44 includes openings 58 selectively positioned such that lettering on the signage strips 54 are visible when slidably disposed within pockets 52 formed in the signboard 14. More specifically, the openings 58 may comprise wider openings 58*a* to permit the display of a number of letters as would be necessary in the display of a menu item, and additionally, narrower openings 58*b* appropriate for the display of information requiring fewer characters such as pricing information.

Figure 5C:
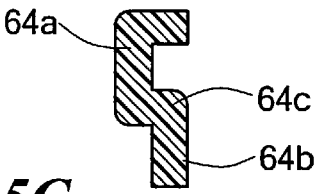
FIG. 5*c* is an enlarged cross-sectional view of a second hanger strip.
Figure 7:
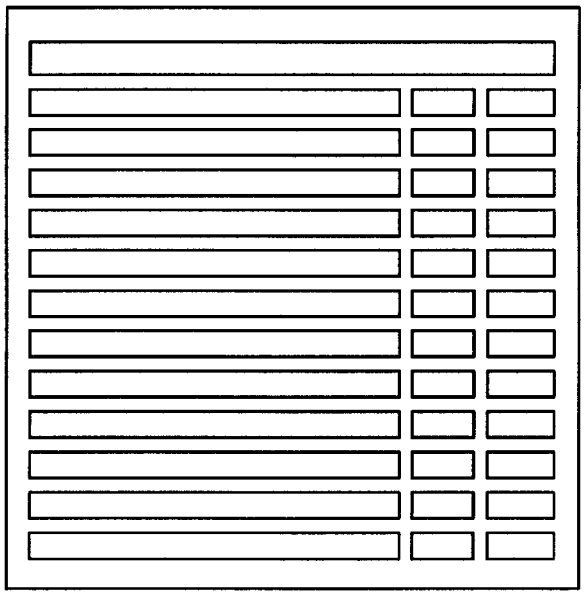
FIG. 7 is a front view of a second alternative embodiment of a signboard for use with a modular sign of the type depicted in FIG. 1.
Figure 5B:
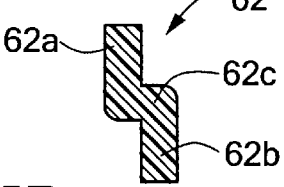
FIG. 5*b* is an enlarged cross-sectional view of a first hanger strip.
Figure 6:
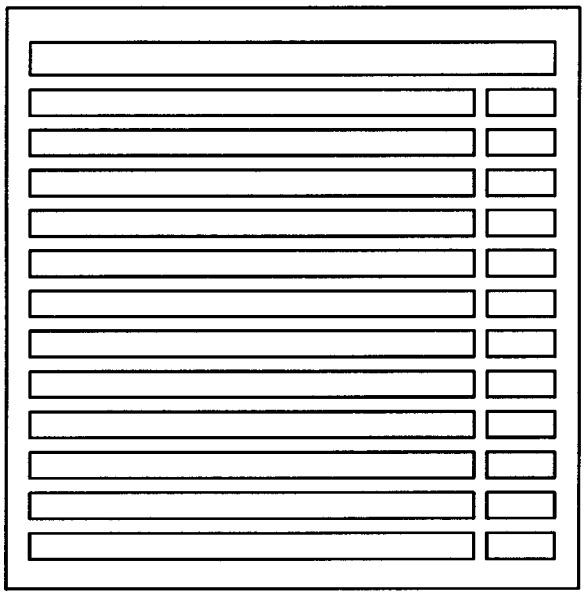
FIG. 6 is a front view of a first alternative embodiment of signboard for use with a modular sign of the type depicted in FIG. 1.
Figure 5A:
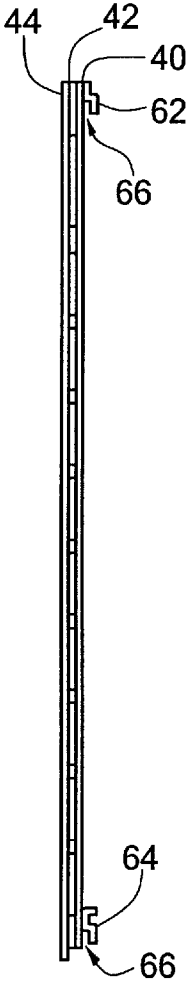
FIG. 5*a* is a side view of the signboard of FIG. 1.
Figure 9:
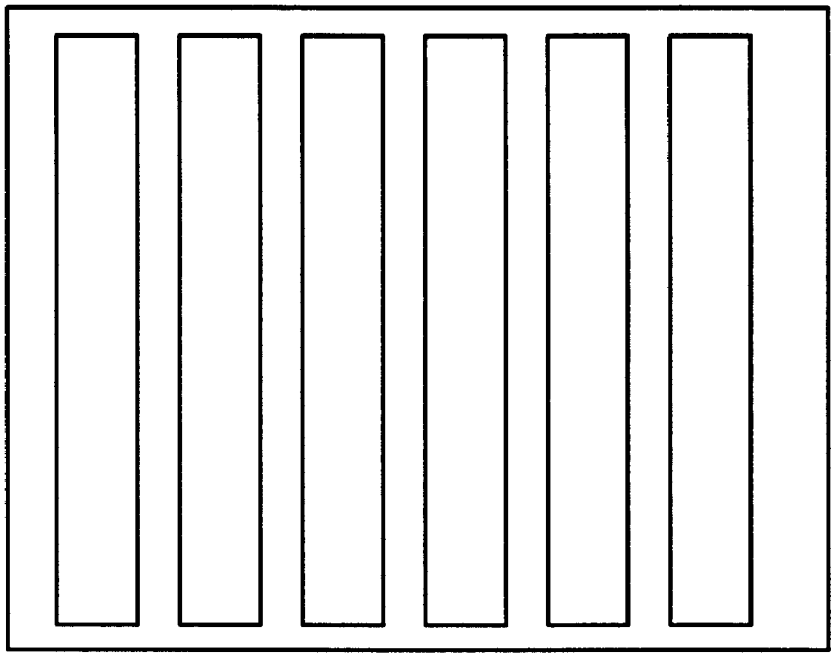
FIG. 9 is a front view of a fourth alternative embodiment of a signboard for use with a modular sign of the type depicted in FIG. 1.
Figure 8:
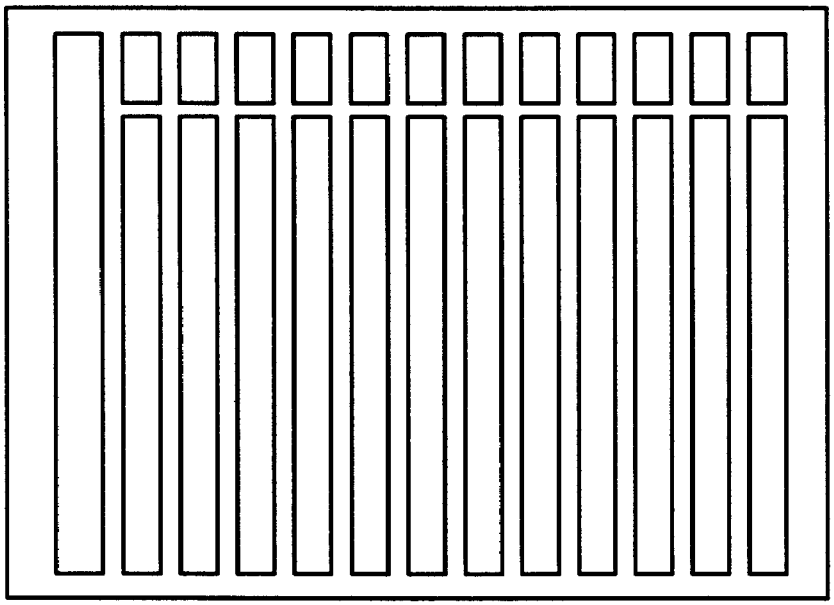
FIG. 8 is a front view of a third alternative embodiment of a signboard for use with a modular sign of the type depicted in FIG. 1.

Upper and lower hanger strips 62 and 64 respectively are mounted to the back side of the backing board 40 adjacent the top and bottom edge of the backing board 40 respectively. More specifically, the hanger strips 62 and 64 may be adhered or bonded to the backing board 40 using any suitable adhesive or bonding agent known in the art or any other suitable fastening technique. For example, the hanger strips 62 and 64 may be screwed to the backing board 40. As depicted in FIGS. 5*b* and 5*c*, the upper and lower hanger strips 62 and 64, respectively have a step shaped cross section. More specifically, referring to FIG. 5*b*, the upper hanger strip 62 has a cross section that includes first and second leg portions 62*a* and 62*b* and a connecting portion 62*c*. Similarly, referring to FIG. 5*c*, the lower hanger strip 64 has a cross section that includes first and second leg portions 64*a* and 64*b* and a connecting portion 64*c*.

The hanger strips are mounted horizontally to the back surface of the backing board 40 with the first leg portions 62*a* and 64*a* abutting the back surface of the backing board 40 so as to form notches 66 (FIG. 5*a*) sized to receive the upward extending first and second mounting edges 28 and 30 when the signboard 14 is disposed in a mounting position with respect to the housing 12. More specifically, the signboard is mounted to the housing by slidably disposing the hanging strips 62 and 64 over the first and second vertical mounting edges 28 and 30 of the housing 12 such that the mounting edges 28 and 30 extend into the notches 66. In this manner the signboard 14 positively engages the housing while permitting the signboard 14 to be easily removed for modifications to the signage strips 54.

Figure 4A:
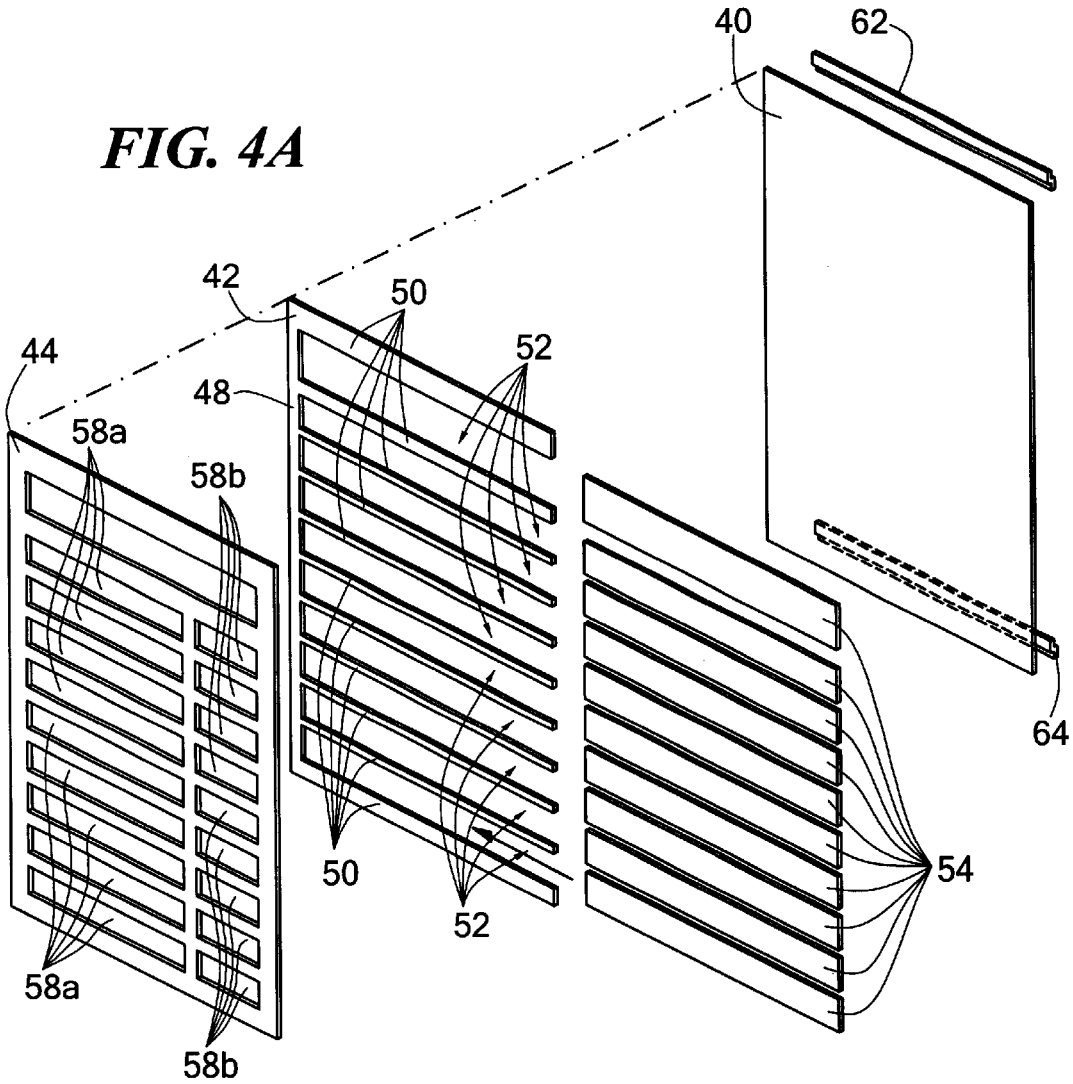
FIG. 4*a* is an exploded perspective view of the signboard of the modular housing of FIG. 1.
Figure 4B:
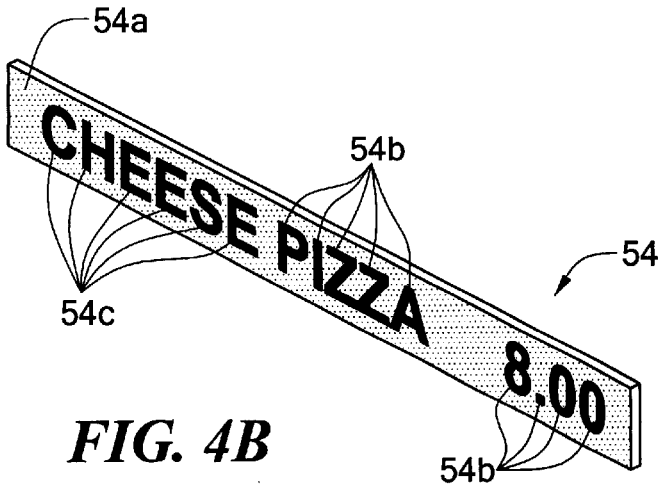
FIG. 4*b* is a perspective view of a signage strip of the type depicted in FIG. 4*a;*

An example of a signage strip 54 is shown in FIG. 4*b*. The signage strip 54 is fabricated from a light transmissive plastic material such as LEXAN™. A vinyl graphic film is preferably applied to first areas 54*a* of the front surface of the signage strip 54 that do not cover the alphanumeric information to be displayed. The light transmittance in the first areas 54*a* of the signage strip is less that the light transmittance in the second areas 54*b* corresponding to the alphanumeric characters that are not covered by the vinyl graphic film. The first areas may be colored; for example, red or green, to create greater contrast between the characters and the background on the signage strips 54. Alternatively, the second areas 54*b* comprising the characters may be covered with a vinyl graphic film or sprayed with a graphic paint and the first or background areas of the signage strip 54*a* may be matt black or painted with a graphic paint of another suitable color. In each case, the light transmittance characteristics of the first and second areas are specified to create suitable contrast so that the characters are readily visible.

Once the signboard 14 is mounted to the housing 12, edge strips 70 are mounted to the frontal portion 38 of corner members 36 to provide a finished appearance to the modular sign. The edge strips 70 may be mounted to the corner members 36 via magnetic strips that are adhered to the backside of the respective corner members. The use of such magnetic strips for the mounting of the edge strips 70 permits the edge strips 70 to be easily and repeatedly removed and remounted as changes to the signboard 14 are necessary. Alternatively, the edge strips 70 may be mounted to the corner members 36 via use or a double-backed adhesive tape, hook and loop fasteners or via any other suitable fastening means.

The signboards may be provided in different configurations to accommodate different display requirements, including different lettering sizes, different numbers of menu items, multiple prices, etc. FIGS. 6, 7, 8, and 9 depict other exemplary signboard configurations that may be employed in a modular sign in accordance with the present invention. Wider and or taller signboard configurations are employed with an appropriately sized housing.

Figure 10:
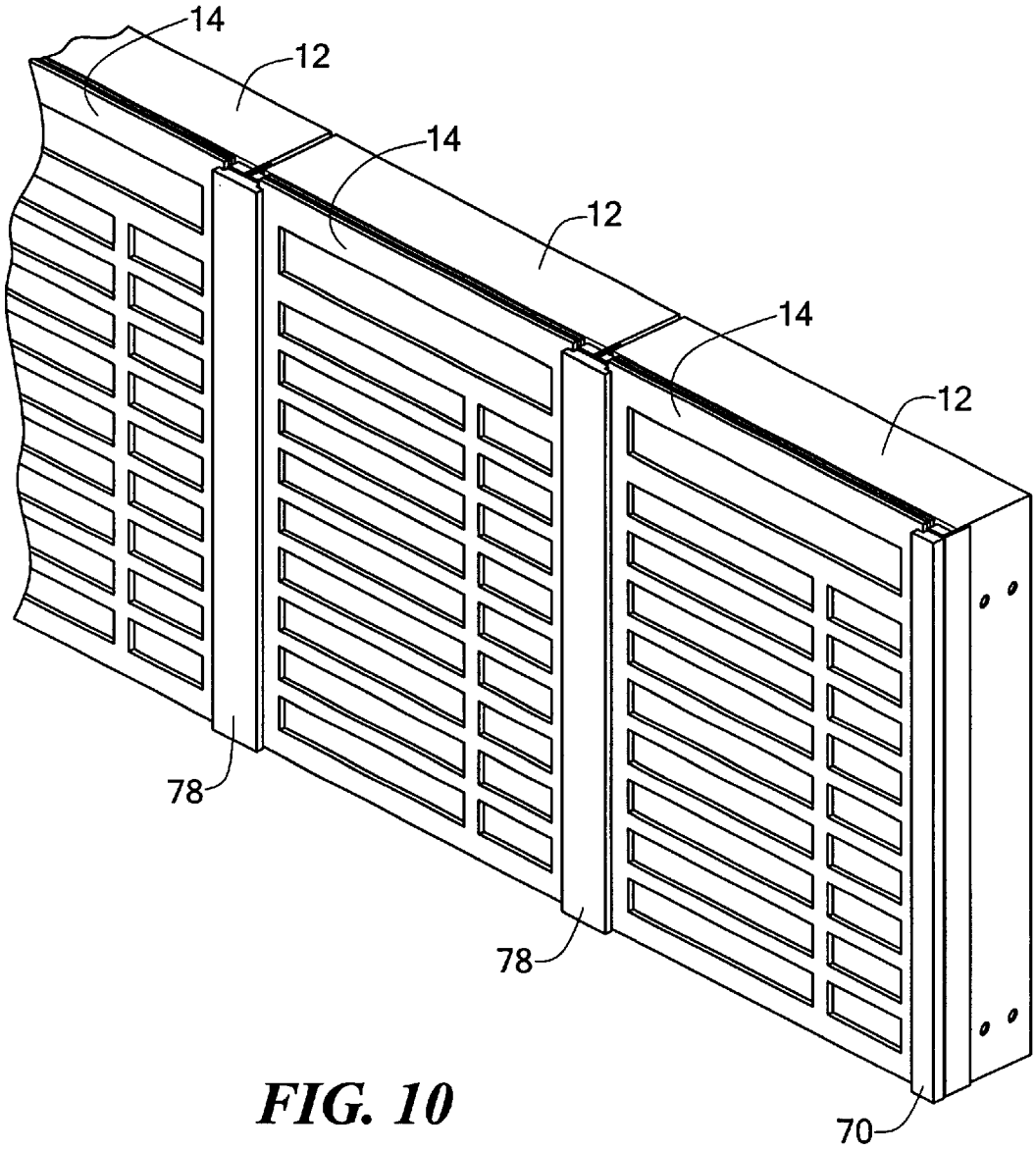
FIG. 10 is a perspective view of a modular sign in accordance with the present invention including plural housings and signboards.

As depicted in FIG. 10, multiple housings 12 and signboards 14 may be arranged side by side to accommodate the need to display more menu or other items than can be accommodated on a single signboard 14. The housings 12 have mounting holes 74 in the left and right side walls 18 and 20 so that adjacent housings 12 may be fastened together via appropriate fasteners such as nuts and bolts, rivets, or any other suitable fastener known in the art.

When multiple housings 12 and signboards 14 are employed intermediate edge strips 78 are employed to cover the joint between adjacent housings and edges of adjacent signboards 14 so as to provide a finished appearance for the modular sign. More specifically, the intermediate edge strips 78 are generally T shaped with the bottom of the T providing a generally planar surface that mounts to the corner members 36 of adjacent housings 12 via a magnetic strip that is adhered to either intermediate edge strip 78 or alternatively via double-backed adhesive tape, hook and loop fasteners, or any other suitable fastener.

It will be appreciated by those of ordinary skill in the art that modifications to and variations of the above-described modular sign may be made without departing from the inventive concepts disclosed herein. Accordingly, the invention should not be viewed as limited except by the scope and spirit of the appended claims.

What is claimed is:

1. A modular sign comprising:

a housing comprising top wall, left and right side walls and a lower wall, each of said walls having a front edge, said housing having a first upward extending lip adjacent the front edge of said top wall;

a generally rectangular signboard having a top edge, a back surface and a plurality of horizontally disposed pockets formed within the signboard for receiving at least one signage strip;

at least one signage strip disposed within at least one of said pockets;

a first hanger mounted to said back surface of said signboard, said hanger cooperative with said first upward extending lip to provide positive removable engagement of said signboard with respect to said housing when said hanger is slidably disposed over said upward extending lip in a mounting. position;

a second lip extending upward from the front edge of said lower wall of said housing; and a second hanger mounted to said back surface of said signboard, said second hanger spaced from and generally parallel to said first hanger, said second hanger cooperative with said second upward extending lip to provide positive releasable engagement of said signboard with respect to said housing when said signboard is disposed in said mounting position with respect to said housing.

2. The modular sign of claim 1 further including a light fixture mounted within said housing for providing backlighting to said signboard.

3. The modular sign of claim 2 wherein said signboard comprises:

a backing board having a back surface;

an intermediate spacing grid comprising a vertical member and a plurality of horizontal members extending from said vertical member in a first direction generally perpendicular to said vertical member;

an outer display grid having a plurality of openings;

said backing board, said intermediate spacing grid and said outer display grid being laminated together with said intermediate spacing grid disposed between said backing board and said outer display grid so as to form said plurality of pockets between adjacent ones of said horizontal members of said intermediate spacing grid;

at least one signage strip disposed within at least one of said pockets;

said openings in said outer display grid being selectively located such that selected portions of said at least one signage strip is visible through one of said openings.

4. The modular sign of claim 2 wherein said signage strips comprise a light transmissive plastic material and said signage strips are selectively coated so as to create first areas having a first light transmittance characteristic and second uncoated areas having a second different light transmittance characteristic.

5. The modular sign of claim 4 wherein said second areas comprise alphanumeric characters and said first areas comprise areas surrounding said alphanumeric characters.

6. The modular sign of claim 5 wherein said first light transmittance characteristic is less than said second light transmittance characteristic.

7. The modular sign of claim 1 wherein said first hanger has a predetermined length and cross-section, wherein said cross-section has first and second leg portions each having respective ends, a connecting portion having first and second ends, said connecting portion being generally perpendicular to said first and second leg portions, wherein said first end of said connection portion is connected to one end of said first leg portion and said second end of said connection portion is connected to one end of said second leg portion and wherein said first and second leg portions are disposed on opposite sides of said connecting portion.

8. The modular sign of claim 7 wherein said first leg portion of said cross-section of said first hanger is mounted to said back surface of said signboard so as to form a notch between said back surface of said signboard and said second leg portion of said cross-section and said first upward extending lip extends into said notch to removably engage said signboard with respect to said housing when said signboard is disposed in said mounting position with respect to said housing.

9. The modular sign of claim 1 wherein said second hanger has a predetermined length and cross-section, wherein said cross-section of said second hanger includes first and second leg portions each having respective ends, a connecting portion having first and second ends, said connecting portion being generally perpendicular to said first and second leg portions, wherein said first end of said connection portion of said second hanger is connected to one end of said first leg portion of said second hanger and said second end of said connection portion of said second hanger is connected to one end of said second leg portion of said second hanger and wherein said first and second leg portions of said second hanger are disposed on opposite sides of said connecting portion of said second hanger.

10. The modular sign of claim 9 wherein said first leg portion of said cross-section of said second hanger is mounted to said back surface of said signboard so as to form a notch between said back surface of said signboard and said second leg portion of said cross-section and said second upward extending lip extends into said notch formed by said second hanger to removably engage said signboard with respect to said housing when said signboard is disposed in said mounting position with respect to said housing.

11. The modular sign of claim 1 further including first and second support flanges inwardly extending from the front edges of respective left and right side walls of said housing, said signboard back surface abutting said first and second flanges when said signboard is disposed in said mounting position with respect to said housing.

* * * * *

UNITED STATES PATENT AND TRADEMARK OFFICE

CERTIFICATE OF CORRECTION

PATENT NO. : 6,742,292 B1
DATED : June 1, 2004
INVENTOR(S) : Ferdinand Albano

It is certified that error appears in the above-identified patent and that said Letters Patent is hereby corrected as shown below:

Column 3,
Line 12, "n order" should read -- in order --; and
Line 15, "s depicted" should read -- is depicted --.

Signed and Sealed this

Twenty-first Day of June, 2005

JON W. DUDAS
*Director of the United States Patent and Trademark Office*